United States Patent [19]

Naevestad

[11] 4,133,721

[45] Jan. 9, 1979

[54] TRAVELING HOOD FOR COKE OVEN EMISSION CONTROL

[75] Inventor: Roy Naevestad, Fanwood, N.J.

[73] Assignee: Wilputte Corporation, New Providence, N.J.

[21] Appl. No.: 818,935

[22] Filed: Jul. 25, 1977

Related U.S. Application Data

[63] Continuation-in-part of Ser. No. 730,075, Oct. 6, 1976, abandoned.

[51] Int. Cl.[2] ..... C10B 27/00; C10B 27/06; C10B 45/00

[52] U.S. Cl. ..... 202/263; 98/115 VM; 202/270

[58] Field of Search ..... 202/227–230, 202/262, 263, 270; 98/115 VM; 214/18 R; 104/94

[56] References Cited

U.S. PATENT DOCUMENTS

| | | | |
|---|---|---|---|
| 809,645 | 1/1906 | Treat | 98/115 VM |
| 3,580,813 | 5/1971 | Hinchliffe | 202/230 X |
| 3,715,282 | 2/1973 | Pries et al. | 202/263 |
| 3,721,609 | 3/1973 | Spindeler | 202/263 |
| 3,729,384 | 4/1973 | Kinzler et al. | 202/263 |
| 3,801,472 | 4/1974 | Kemmetmueller | 202/263 |
| 3,801,473 | 4/1974 | Schoen et al. | 202/263 |
| 3,839,161 | 10/1974 | Pries | 98/115 VM |
| 3,843,461 | 10/1974 | Allen | 202/227 |
| 3,869,352 | 3/1975 | Allen et al. | 202/263 X |
| 3,955,484 | 5/1975 | Hirahama et al. | 95/115 VM |
| 3,966,563 | 9/1973 | Armour et al. | 202/228 |
| 3,972,780 | 8/1976 | Calderon | 202/227 |
| 3,981,778 | 9/1976 | Schulte et al. | 202/263 |
| 4,026,200 | 5/1977 | Lindqvist | 98/115 VM |

*Primary Examiner*—Morris O. Wolk
*Assistant Examiner*—Michael S. Marcus
*Attorney, Agent, or Firm*—Buell, Blenko & Ziesenheim

[57] ABSTRACT

Coke oven emission control system comprising a traveling hood for collecting the emissions arising from the quench car into which hot coke is pushed from the coke ovens. The hood has a U-shaped snorkel at the top of the hood extending longitudinally of the hood, which connects to an exhaust duct via a water trough. Within the hood are a number of nozzles which are adjusted to provide a fogging mist of atomized water particles at the time a coke oven is "pushed" which cools the emissions which rise from the quench car and thereby reduces their volume as they flow into the exhaust duct. In a modification, a venturi type scrubber in the snorkel tube serves to separate the particulates, and cool the gases as they flow to the exhaust duct. In a further modification, high pressure jets are mounted on the snorkel tube within the water trough to agitate the particulates and solids on the bottom of the water trough to assist in their removal by draining from the trough.

4 Claims, 7 Drawing Figures

TRAVELING HOOD FOR COKE OVEN EMISSION CONTROL

Figure 1:
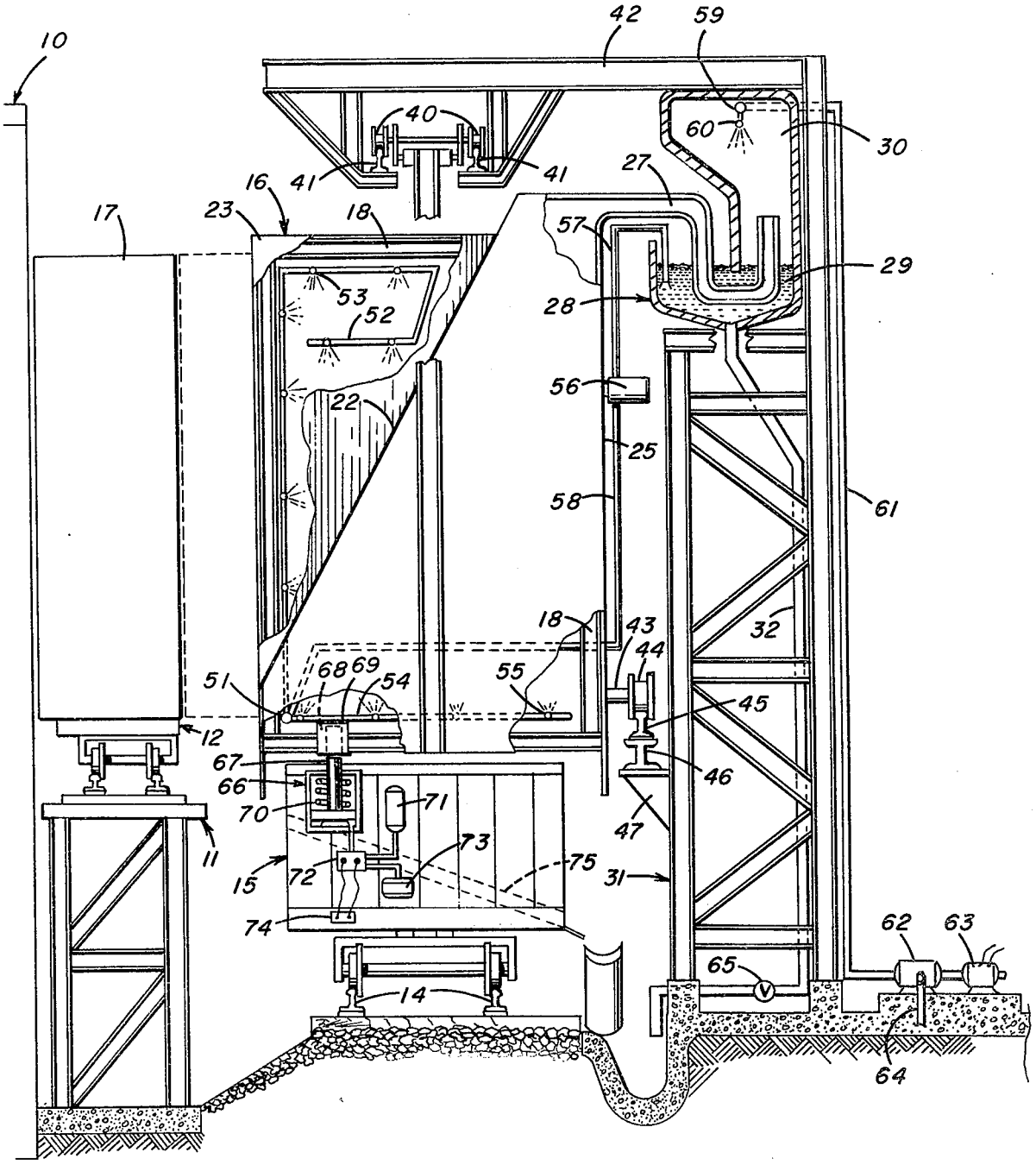

This application is a continuation-in-part application of my copending application Ser. No. 730,075, filed Oct. 6, 1976, to be abandoned concurrently with the filing of this application.

This invention relates to coke oven emission control systems for preventing air pollution by smoke, gas, fumes and particulates otherwise discharged into the atmosphere above a quench car at the time the hot coke is pushed out of a coke oven at the conclusion of the heating cycle. Specifically this invention relates to traveling hood means superposed over the quench car and alignable with different ovens of a coke oven battery at the time a coke oven is pushed to collect therein smoke, gas, fumes and particulates arising from the pushing operation.

In particular, the invention relates to a traveling hood having means in the form of a U-shaped "snorkel" tube extension of the hood which is submerged in a longitudinally divided water trough for continuously connecting the hood to an exhaust duct paralleling the coke oven battery.

The invention further relates to a system of fogging or misting nozzle means within the traveling hood for cooling the gases, smoke and particulates to reduce their volume prior to entering the exhaust duct.

The invention further relates to a venturi-type scrubber within the snorkel tube on the hood, by which to cool the gases and particulates prior to entry into the exhaust duct.

The invention also relates to a system of high pressure jets mounted on the snorkel tube within the water trough for agitating the solids being built-up within the water trough to assist in removal thereof via the drainage tube extending therefrom.

In view of wide spread anti-air-pollution legislation, particularly for industrial communities such as steel-making communities, various proposals have been made for reducing or eliminating emission of smoke, gases, fumes and particulates into the atmosphere surrounding coke oven batteries, incidental to pushing of the hot coke out of the ovens into quench cars traveling on tracks parallel to the ovens. These proposals include various forms and sizes of hoods movable into position for collection of smoke, gases, fumes and particulates arising from the quench car incidental to the coke pushing operation. U.S. Pat. Nos. 3,801,472 and 3,801,473 both issued on Apr. 2, 1974, severally disclose hood means adapted to be connected through telescoping duct work or through a water trough type of seal to an exhaust duct paralleling the coke oven battery by which the smoke, gas, fumes and particulates are removed and scrubbed, or further processed. U.S. Pat. No. 3,729,384 issued Apr. 24, 1973, discloses a traveling hood means having a connection to an exhaust duct via a longitudinal flexible belt, which closes one side of an exhaust duct except at the point of the oven being pushed.

U.S. Pat. No. 3,647,636 issued Mar. 7, 1962, discloses a system for the same general smoke, gas, etc. collection function, in which a hood is rollably mounted on a quench car and is connected to an exhaust duct via telescoping ducts which communicate therewith through trap doors in the exhaust duct.

In my copending application Ser. No. 690,415, filed May 27, 1976, there is disclosed a traveling hood system for coke oven emission control, in which a collecting hood, corresponding in length to a quench car, is movably mounted for travel parallel to a coke oven battery by means of side-mounted upper and lower pairs of wheels running on cooperating vertically spaced rails. In this application there is further disclosed an elongated collar at the top of the hood which extends into an exhaust duct and slides between two parallel flexible sealing strips which are normally biased into sealing contact to close a longitudinal slot in the exhaust duct, thereby providing a continuous connection between the traveling hood and the stationary exhaust duct.

It is the purpose of this invention to provide a traveling hood system for coke oven batteries in which a continuous connection is provided between a traveling hood and an exhaust duct through a U-shaped snorkel tube extension of the hood which moves in a longitudinally divided water trough, the bottom of the trough being sloped to a longitudinally central low point for collecting and conducting coke fines settling therein to a quenching station sump.

I further provide a traveling hood system comprising a series of nozzles arranged longitudinally within the hood for creating a fogging mist within the hood whereby to cause gases, smoke, particulates and coke fines to be cooled and reduced in volume prior to reaching the exhaust duct.

I further provide a traveling hood system having a series of water jets mounted on the snorkel tube within the water trough for sweeping the particulates and solids settling in the water trough toward the drainage tubes in the floor of the water trough.

I further provide a traveling hood system of the aforementioned snorkel tube type in which a venturi-type scrubber is provided within the snorkel tube upstream of the opening into the exhaust duct for cooling and reducing the volume of the gases, smoke and particulates prior to entry into the exhaust duct.

Figure 2:
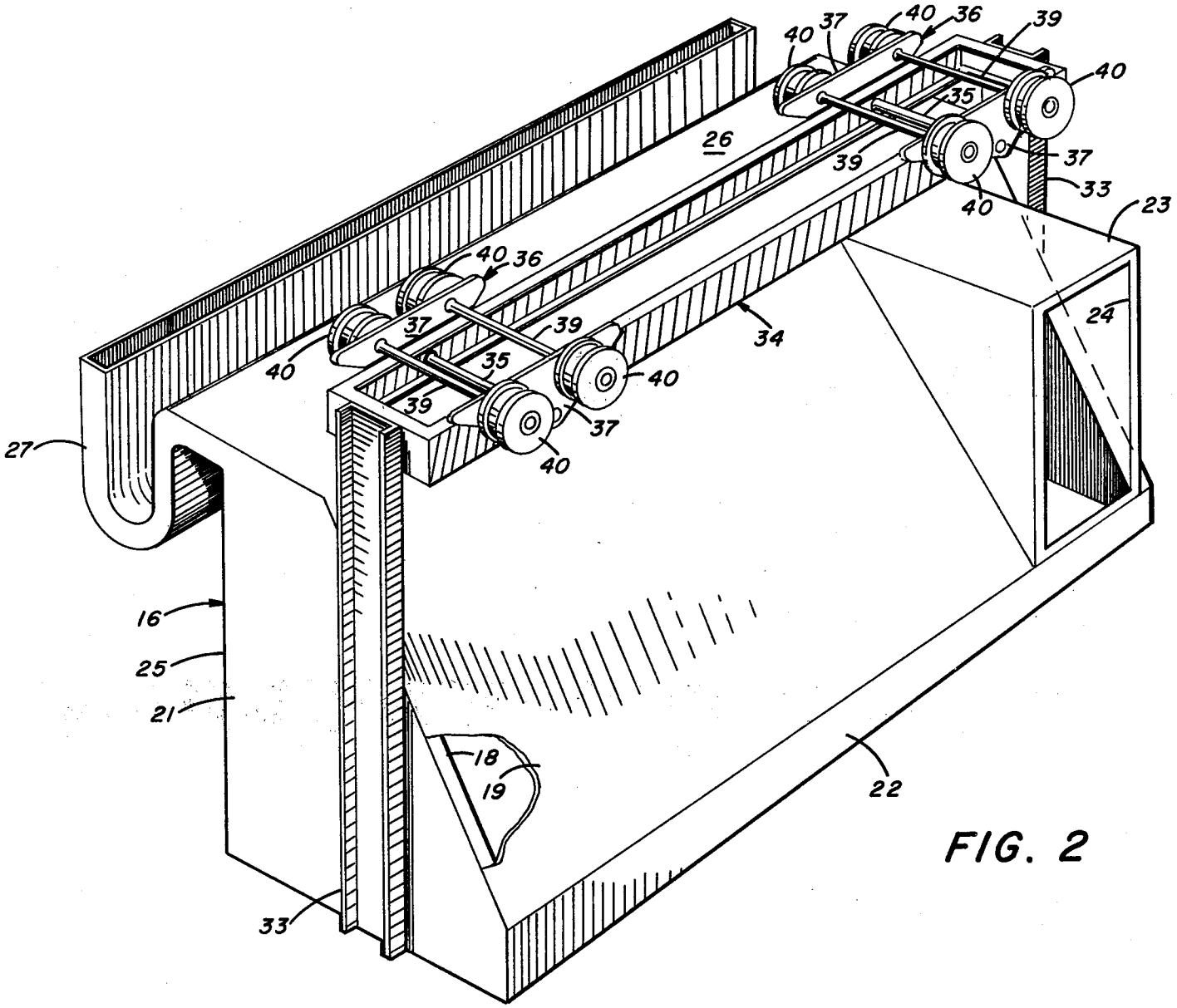
Figure 3:
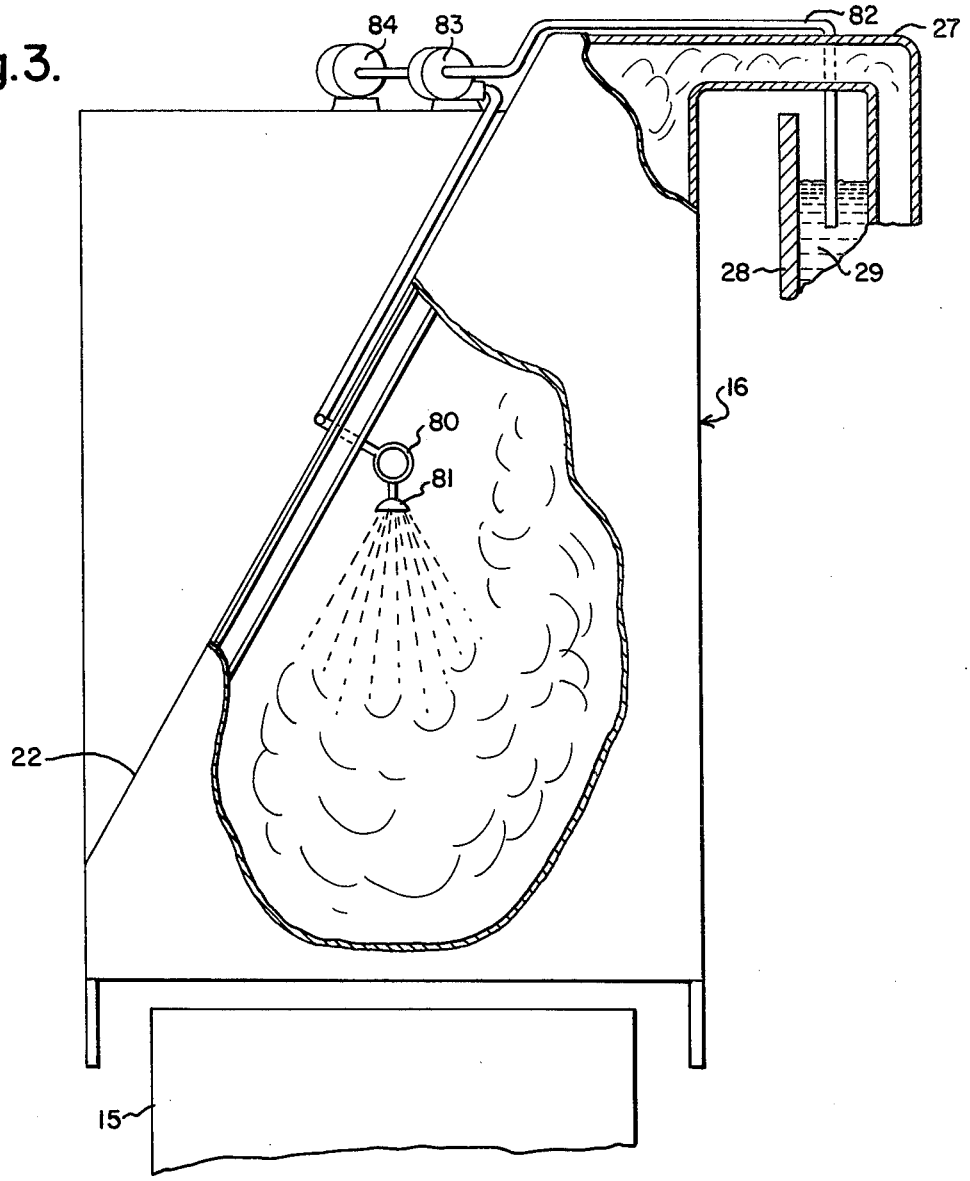
Figure 4:
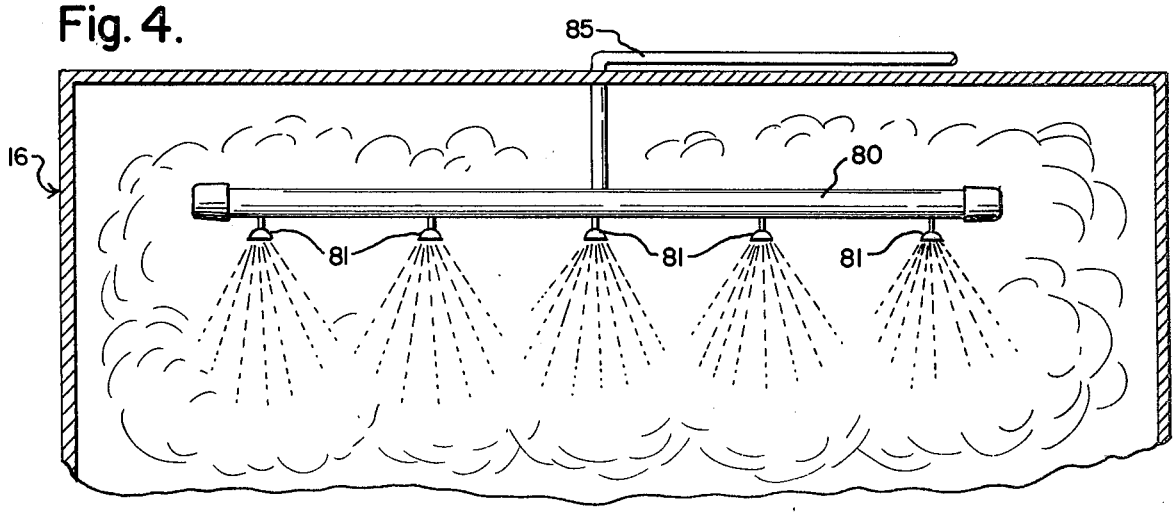
Figure 7:
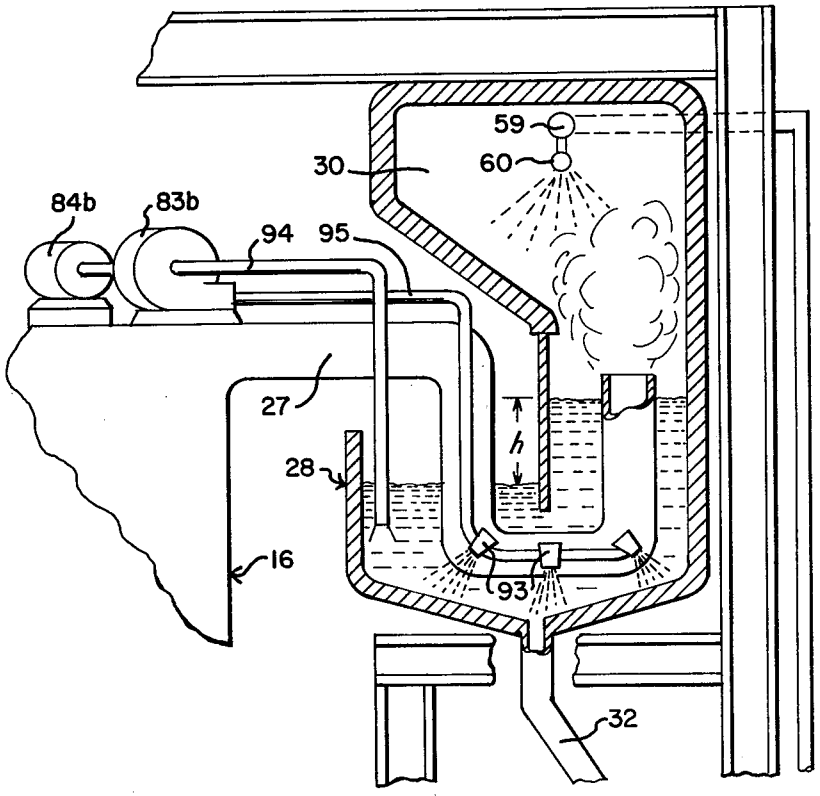
Figure 6:
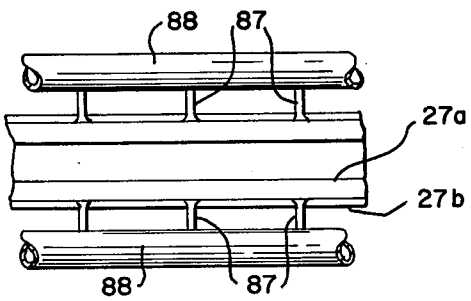
Figure 5:
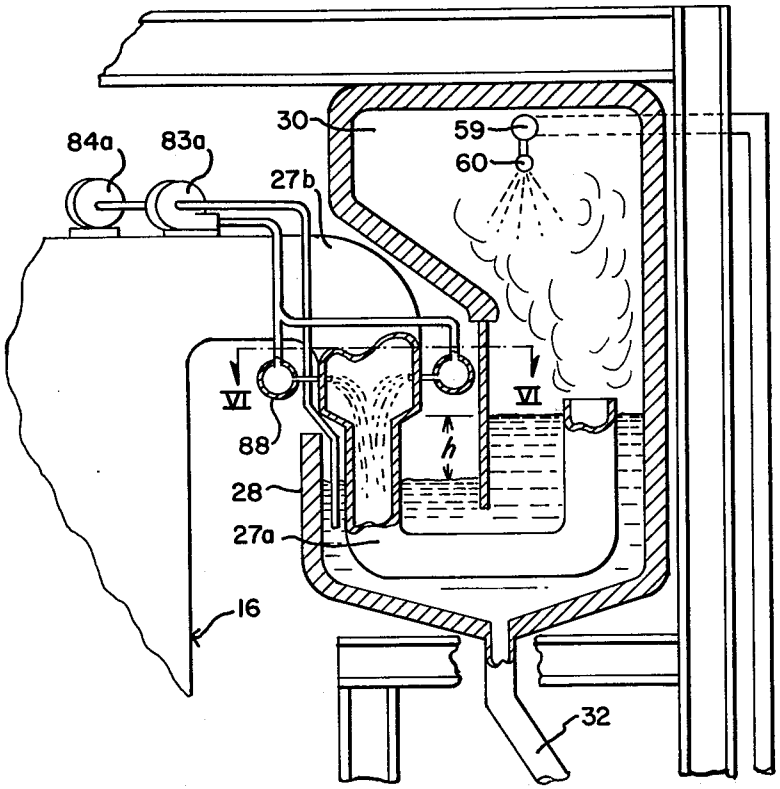

The above features and other features of my invention are shown in connection with a preferred embodiment thereof which will be described in detail hereinafter in relation to the accompanying drawings wherein:

FIG. 1 is a transverse elevational view showing a traveling hood system embodying my invention, FIG. 2 is a perspective view, on somewhat enlarged scale, showing the details of my traveling hood and the manner of suspension thereof, FIGS. 3 and 4 are fragmental transverse and longitudinal sectional views, respectively of the hood shown in FIGS. 1 and 2, showing the system of nozzles for creating a fogging mist within the hood, FIG. 5 is a fragmental view, in section, showing a modification of the hood of FIGS. 1 and 2, in which a venturi-type scrubber is embodied within the snorkel tube, FIG. 6 is a fragmental sectional view, taken on the line VI—VI of FIG. 5, showing further details of the venturi scrubber shown in FIG. 5, FIG. 7 is a fragmental view, in section, showing a modification of the traveling hood of FIGS. 1 and 2, wherein a system of high-pressure jets are mounted on the snorkel tube for sweeping the particulates and solids settling on the floor of the water trough.

Referring to the drawings, there is shown a battery of coke ovens 10, a platform 11 paralleling the coke ovens in front of the coke oven doors, and a coke guide car 12 having wheels by which the car travels on the rails 13 of a track attached to platform 11. Paralleling the platform and spaced therefrom is a track having rails 14 on which the wheels of a quench car 15 of the railroad type run. A hood 16 is movably suspended over the quench car, in the manner later more fully explained, and is thereby adapted to travel to different positions opposite the doors of respective coke ovens 10 in the battery.

It will be understood that the coke guide car 12 is provided with a coke guide 17, which is a tunnel-like structure, and is movable, as by the usual door opening and closing machine which runs on the same track rails 13 as the coke guide car, into alignment with a selected coke oven door. The coke guide 17 is constructed so as to be extendible into contact with the face of the oven door frame and into contact with the side wall of the hood facing the coke guide, as indicated by the broken lines.

The hood 16 has a structural beam framework 18 covered by sheet metal 19, such as steel. As particularly seen in FIG. 2, the hood is of rectangular shape at the bottom and the end walls 21 approximate a trapezoidal shape. The side wall 22 of the hood adjacent the coke oven battery slopes away from the ovens toward the top except for a dormer 23 in the side wall which has a vertical face with a doorway and frame 24 adapted to register closely with the extended coke guide 17.

The side wall 25 of the hood opposite the dormer 23 is vertical or nearly so. Adjacent the top wall 26 of the hood and opening longitudinally out of the side wall 25 is a duct 27 which extends laterally away from the hood and then follows a U-shaped contour, the end of the duct being open upwardly. The U-portion of duct 27, hereinafter designated the snorkel duct, is adapted to be submerged in a trough 28 containing a liquid, such as water 29. One side wall of the trough, which is made preferably of corrosion resistant metal, such as stainless steel, extends upwardly then laterally and downwardly to form a duct or longitudinal chamber 30. The downward extension of the trough side wall re-enters the liquid in the trough 28 substantially midway between the two side walls of the trough, thereby sealing the space within the duct or chamber 30. It will be understood that trough 28 is carried on supporting towers 31 of steel framework, and extends longitudinally parallel to and coextensively with the battery of coke ovens 10, the duct 30 being connected to an exhaust blower or scrubber (not shown) functioning for a purpose hereafter described. It will be seen that the snorkel duct 27 thus provides continuous communication between the interior of the hood 16 and the duct 30 as the hood travels along parallel to the battery of coke ovens 10.

The bottom of the trough 28 is sloped laterally to a low point near the longitudinal middle line thereof, and drainage pipes 32, one of which is shown, connected thereto are provided by which to remove coke fines collecting therein, as hereinafter described.

As will be seen in FIG. 2, the hood 16 has vertical end columns or channels 33 between which a rectangular frame 34 extends at a level above the top wall 26 of the hood. Pivotally carried on two pivot rods 35 respectively, at opposite ends of the frame 34, are two wheel trucks 36. Each wheel truck may comprise two triangular end plates 37 pivotally mounted on opposite ends of the pivot rods 35 and support two wheel-and-axle units in parallel longitudinally spaced relation. Each wheel and axle unit comprises an axle 39 rotatably supported adjacent opposite ends in the end plates 37 and having a pair of wheels 40 fixed to the axle 39 at its opposite ends. The wheels 40 are preferably double-flanged to provide a pulley-like groove for engaging a corresponding spaced pair of parallel-extending rails 41.

As seen in FIG. 1, rails 41 are supported longitudinally on underslung portions of a steel frame 42 or arm attached in cantilever fashion to the top of each of the series of towers 31. With the wheels 40 of the wheel trucks engaging the rails 41, the end channels 33 of the hood hang down centrally between the rails 41, thereby correspondingly centering the hood over the quench car 15 riding on track rails 14.

Rotatably mounted on short stub axles 43, fixed to the frame work of the hood at approximately the level of the coke oven floors, are a pair of longitudinally spaced thrust pulleys 44, (only one is visible) which engage a longitudinal rail 45, to stabilize the hood against excessive lateral swinging relative to the quench car 15. The rail 45 is supported on and attached to a structural beam 46, in turn resting on brackets 47 attached to one of the vertical structural frame members of the towers 31.

As shown in FIG. 1, a spray system is provided on the hood 16. This system comprises a header pipe 51 attached to the inside of side wall 22 and extending longitudinally of the hood at a level slightly below the bottom of the door frame 42. To this header pipe 51 are connected two branch pipes 52 (only one being shown) having spray nozzles 53 therein which are supplied with water under pressure therefrom. Pipes 52 are attached to the inside of the opposite side walls of dormer 23 and the nozzle sprays are directed inwardly.

Also connected to and supplied with water under pressure from the header pipe 51 are branch pipes 54 (only one being shown) in which are a series of spray nozzles 55 spaced at intervals. These branch pipes 54 are attached to the interior of the hood walls substantially at the level of the bottom of the door frame 24.

Water under pressure is supplied to the header piper 51 from the water 29 in the trough 28 by a motor driven pump 56 mounted on the outside wall of the hood. An intake pipe 57 for the pump is submerged below the level of the water in the trough and a delivery pipe 58 is connected to the header pipe 51.

When hot coke is pushed out of an oven into the quench car 15 through the coke guide 17, the sprays from nozzles 53 serve to reduce the dust generated during the fall of the coke into the quenching car. These sprays also provide some slight measure of coke quenching. The sprays from nozzles 55 serve to quench the coke as it falls into the quench car. If these sprays are in sufficient volume it may be that further quenching at a quench station may be dispensed with.

Another spray system is provided in connection with the exhaust duct 30. This spray system comprises a header pipe 59 attached inside the top wall of the duct 30 and having a series of spray nozzles 60 at intervals along the length thereof. Water under pressure is supplied to header pipe 59 via a delivery pipe 61 from a pump 62, driven by motor 63, the intake pipe 64 being connected to the water trough 28 or to some external source. The spray from nozzles 60 serves to remove coke fines and other particulates from the smoke, gases and fines being withdrawn from the hood via the exhaust duct 30. The quenched coke fines settle in the sloping bottom of the water trough 28 from which they may be removed by drainage via the drain pipes 32. An automatic valve 65 may be provided in each of the drain pipes 32 for controlling drainage through the pipes 32.

One or more interlock mechanisms are provided at each end of the quench car for coupling the quench car 15 and the hood 16 together after a "push," so that the hood remains over the quench car (1) while a locomotive moves the quench car to a quench station and (2) while the quench car is being moved to a dumping wharf and then to a position for receiving hot coke from the next oven to be pushed. By way of example, the single interlock mechanism shown may comprise a hydraulic pressure actuated cylinder 66, mounted on the quench car 15, and having a piston-actuated plunger 67, which telescopes into a recess 68 in a member 69 attached to the frame work 18 of the hood 16. The piston-actuated plunger 67 is biased, as by a coil spring 70, to an unlocked position out of engagement with the recess 68. Hydraulic fluid under pressure is supplied to the piston-actuated plunger 67 from a cylinder or reservoir 71 under control of an electrically operated valve 72 which on deactivation releases the hydraulic fluid back to a sump reservoir 73. The terminals of valve 72 are connected by a pair of wires to the terminals of a socket member 74 attached to the sill of the quench car. By means of a cable connector (not shown) the socket member 74 is connected to controls on the locomotive for moving the quench car, thus enabling the operator in the cab of the locomotive to operate the interlock mechanism as needed.

Having described the apparatus comprising my invention, a typical cycle of operation will now be described. Let it be assumed that the hood 16 and quench car 15 are locked together by the interlock mechanism described, and while so interlocked, the locomotive moves the quench car and the coupled hood to a position in which the coke guide 17 may be extended to connect a coke oven, from which the door has been removed in conventional manner by a door machine, to the door frame 24 on the hood. After the oven is connected to the hood, as just described, the locomotive operator uncouples the interlock mechanism to permit the quench car to be moved relative to the hood. As the hot coke is pushed out of the oven into the quench car, the locomotive operator pushes the quench car slowly relative to the hood. During this period, spray nozzles 53 are turned on to spray water on the cloud of coke fines and particles rising from the quench car to cause them to settle down. At the same time, or later, the spray nozzles 55 are turned on to spray water on the hot coke in the quench car to at least partially quench the coke.

During the pushing period, the gas, smoke, fumes and coke fines collected in the hood are continuously drawn out into the exhaust duct 30 due to the suction created by the exhaust fan. The spray nozzles 60 in the duct 30 are also turned on at this time and by wetting the coke fines cause them to settle in the bottom of the trough 28. After a quantity of such fines are collected in the trough, they are drained periodically by the automatic valve 65 in the drain pipe 32.

At the completion of the push, the quench car will have reached a position of maximum displacement relative to the hood and the quench car will have been filled by coke distributed uniformly along the length of the quench car. At this time, the door machine operator retracts the coke guide from the door frame 24 of the hood, and the driver of the locomotive operates one of the interlock mechanisms to again lock the hood to the quench car.

The locomotive then moves the quench car and connected hood together to a position outside the quenching tower. At this point, the hood is uncoupled or unlocked from the quench car, which is then pushed by the locomotive into the quenching tower. Automatic means (not shown) may be provided to cause the interlock mechanism to be unlocked; if the appropriate action is not taken manually.

After the hot coke in the quench car has been quenched within the quench tower, the quench car is moved back out of the quench tower and under the parked hood, where the interlock mechanism is again operated to interlock the hood with the quench car.

The locomotive now moves the quench car and hood together to an unloading zone where the coke is unloaded. The unloading is accomplished by opening the swing doors on the side of the quench car, the coke then sliding off the laterally sloping bottom 75 of the quench car to the wharf platform or conveyor.

Upon completion of the unloading of the quench car, the swing doors are reclosed and locked and the quench car and hood together moved by the locomotive back to a position for unloading of another of the ovens in the battery in the manner previously described.

Referring now to FIGS. 3 and 4, there is shown a modification of the traveling hood in which is embodied a system for creating within the hood highly atomized clouds of mist or fog, the function of which is to cool the clouds of gases, smoke and particulates which arises from the quench car at the time the hot coke falls therein at the time of a "push." As a consequence of the cooling effect, the volume of the gases, smoke, etc., is reduced in accordance with the law of gases, such as Charles' Law. Such reduction of volume necessarily reduces the capacity requirements of the fan or blower connected to the exhaust duct 30.

As shown, the misting or fogging system comprises a header pipe 80 suitably suspended, as by brackets not shown, from the sloping wall 22 of the hood and extending longitudinally into close proximity with the end walls of the hood. Attached to the header 80 are a series of fogging or misting nozzles 81 located in spaced relation along the header. Nozzles 81 are so constructed as to cause atomization of the water delivered therefrom, as distinct from a spray. As a matter of fact, it is not intended that nozzles 81 function to quench the hot coke that falls from the coke guide into the quench car.

As in the previously described embodiment of FIGS. 1 and 2, the water for providing the mist or fog within the hood is also drawn from the water trough 28 via an intake pipe 82 that extends below the level of the body of water in the trough 28. If desired, a mobile tank for water may be employed. A suitable pump, such as a centrifugal pump 83, driven by an electric motor 84 is mounted as on the top of the hood 16 and serves to draw water from the trough 28 via intake pipe 82 and delivers the water under pressure to the header pipe 80, through a branch pipe 85. Branch pipe 85 is preferably connected to header pipe 80 at a point midway of the ends thereof to move nearly equalize the pressure at all the nozzles. If desired, multiple connections from delivery pipe 85 to the header pipe 80 may be employed.

As apparent from FIG. 4, the clouds of mist or fog are emitted from the nozzles 81 in overlapping conical patterns to provide maximum coverage or blending with the gases, smoke, and other particles as they arise from the quench car. Though only one header pipe 80 is shown, a plurality of parallel extending header pipes with corresponding multiplication of nozzles 81 may be provided. Thus, effective cooling of the gases results, with the consequence that the volume is necessarily reduced. This reduces the necessity for having an excessively large capacity blower or fan connected to the exhaust duct 30.

Though not shown, it will be understood that conventional means may be employed to start and stop the motor 84, to control the duration of the misting or fogging operation. Customarily, it will be desirable to commence the misting operation about the time the first quantity of hot coke hits the quench car, to be sure to treat all gases, smoke, etc. as it arises. Also, the motor 84 may be desirably stopped a short time after the "push" of hot coke is completed.

Referring now to FIGS. 5 and 6, a further modification of a traveling hood is shown, wherein a type of venturi scrubber is embodied within the snorkel duct of the hood. For convenience, the same reference numerals are used to identify parts corresponding to those of prior embodiments. In this embodiment, however, the snorkel duct consists of two parts, the U-shaped part submerged in the trough 28 being identified by reference numeral **27*a* and the portion extending from the hood 16 to the duct portion 27*a* being identified by the reference numeral 27*b*. Duct portion 27*b* is larger in cross-sectional area than duct portion 27*a*, thereby providing a restriction of the cross-sectional area within the snorkel duct upstream from the opening into chamber 30**.

A water pressure system is provided for supplying water under pressure to a series of nozzles or ports 87, in each of a pair of parallel-extending headers 88 on opposite sides of the vertical portion of duct **27*b*, the nozzles 87 opening into the vertical part of the duct section 27*b*. The nozzles produce a fine spray or mist of water into the path of flow of gases, smoke and particulates just prior to entry into the restricted cross-sectional area of duct portion 27*a***.

As in the previously described embodiment of FIGS. 3 and 4, the water system comprises a pump **83*a* and a driving motor 84*a* carried on the hood, the pump drawing water from the water trough 28 via an intake pipe 90 and supplying water under pressure to the headers 88 via a delivery pipe 91. A separate mobile unit with a separate water tank, may be employed as the source of water, if desired. With an exhaust blower or fan (not shown) connected to the exhaust duct 30 for removing the gases, smoke and particulates, a pressure drop occurs across the venturi restriction between the duct section 27*b* and duct section 27*a*. As shown in FIG. 5, this pressure drop is reflected in the difference in water levels in the portions of the water trough open to the exhaust duct chamber 30** and that open to atmosphere, and represented by the letter "h."

In its operation, the venturi restriction at duct **27*a* causes an increase in velocity of flow of gases, smoke, and particulates at the same time that water spray or mist is introduced into the effluent stream flowing to exhaust duct chamber 30. This produces a turbulent mixing or blending action necessary to insure good contact of the particulate matter with water particles or droplets. With a thorough blending of water and particulate matter, a sludge is provided which will drop to the bottom of the water trough 28 as it leaves the open inner end of duct section 27*a* within chamber 30. This sludge is removed via the drainage pipes 32**, as in previous embodiments.

With a low pressure drop "h" across the venturi duct sections, the collected gases and smoke emitted from the hood will be preconditioned by removal of large particulate matter and partially saturate the gas before the effluent enters the exhaust duct 30. This will reduce the size and cost of equipment provided for removal of emissions from the exhaust duct 30, primarily by lowering the temperature and volume of the gases. Moreover, with a low pressure drop "h", the emitted gases will be preconditioned prior to a scrubbing system, a wet electrostatic precipitator or other gas cleaning system connected to the exhaust duct 30.

With a high pressure drop "h," the collected gases emitted from the hood will be completely scrubbed, that is cleaned of particulates and the need for a scrubber in connection with an exhaust fan connected to the exhaust duct 30 may be eliminated, though of course a fan is required for producing the pressure drop "h."

It will be apparent that this embodiment will provide a unique control over some of the problems created by a green "push," though primarily it will serve to control gas temperature.

Referring now to FIG. 7, a further modified embodiment of a traveling hood system is shown, in which means is provided for controlling the normal build-up of solid particulates that settle and deposit on the bottom of the water trough 28 during regular plant operation.

Essentially, this embodiment employs a series of nozzles 93 carried on the snorkel duct 27 from which to project high velocity jets of water directly on the deposits of sludge or particulates collected or built-up on the floor of the water trough. As shown, three nozzles 93 are shown attached at one end of the snorkel duct 27, though it should be understood that three nozzles 93 are similarly attached to the opposite end of the snorkel duct. The angles at which the nozzles 93 are directed are such as to cover the entire bottom or floor of the trough 28.

A water pressure system, similar to that employed in previous embodiments may be provided for supplying water under pressure to the nozzles 93. Thus, as shown, a pump **83*b* and driving motor 84*b* are mounted on the hood and an intake pipe 94 for the pump is submerged in the water within the trough 28. A delivery pipe 95, connected to the output port of the pump 83*b*, supplies water under high pressure directly to the nozzles 93**.

It will be understood that the nozzles 93, spewing out high-velocity jets of water directly on the deposits on the floor of the trough, effectively sweeps or cleans the sludge therefrom and causes it to be removed by draining out through drain pipes 32.

While the nozzles 93 are shown as carried by the snorkel duct 27, it will be understood that a water system including nozzles, similar to nozzles 93, pump **83*b* and motor 84*b***, may be carried on a separate mobile unit traveling on the quench car tracks.

It will be seen also, that, if desired, additional nozzles may be mounted on the snorkel duct 27 so as to direct jets of high-velocity water directly on the interior walls of the exhaust duct chamber 30, for cleaning purposes.

In summary, it will be seen that I have disclosed several embodiments of a traveling hood system, embodying several different means for controlling the temperature and volume of gases emitted from the hood into an exhaust duct subject to a negative pressure for removal to a central cleaning and/or scrubbing apparatus. In one of the embodiments venturi type scrubbing means located in the snorkel tube of the hood serves to scrub the gases and reduce the volume of gases reaching the exhaust duct. In another of the embodiments a water pressure system is employed for removing deposits of sludge and particulates within the exhaust duct itself and otherwise cleaning the walls of the exhaust duct.

While I have shown and described specific embodiments of my invention, it will be understood that variations of the embodiments are possible within the terms of the appended claims.

I claim:

1. The combination of a coke oven battery having a plurality of coke ovens in side-by-side relation, a track paralleling the coke oven battery on the coke side and a quench car traveling on said track into which hot coke is pushed selectively from the coke ovens of said coke oven battery, a hood traveling on a track, suspended over the quench car, and movable into close overhead registry therewith, an exhaust duct paralleling and coextensive in length with the cokeoven battery, said exhaust duct comprising water trough means which is coextensive to said exhaust duct, wherein the improvement comprises a lateral U-shaped extension duct on said hood through which emissions collected in said hood flow to the exhaust duct, said U-shaped extension duct comprising an upstream section and a downstream section, the downstream section being smaller in cross-sectional area than the upstream section and providing a venture-like restriction to flow of emissions from the said hood to said exhaust duct across which a pressure differential exists, and a water pressure system including a series of nozzles in the upstream section of said U-shaped extension duct for laterally projecting a spray of water into the flow of emissions immediately in advance of the restriction provided by said downstream section, to effect a blending of said spray with said emissions to produce a cooling and a cleaning of said emissions prior to entry into said exhaust duct.

2. The combination according to claim 1, wherein said water pressure system comprises a pump and a motor for driving said pump carried on said hood, a water intake pipe via which said pump withdraws water from said water trough means, a pair of parallel extending header pipes located on opposite sides of the upstream section of said extension duct to which said pump delivers water under pressure, said nozzles being disposed in spaced relation along and connected to said header pipes.

3. The combination of a coke oven battery having a plurality of coke ovens in side-by-side relation, a track paralleling the coke oven battery on the coke side, a quench car traveling on said track into which hot coke is pushed selectively from the coke ovens of the coke oven battery, a hood traveling on a track suspended over the quench car and being movable into close overhead registry therewith, said hood acting to collect emissions including smoke, fumes, gases and particulates arising from hot coke deposited in the quench car upon being pushed out of the coke side of said ovens, a water trough paralleling the coke oven battery and divided into two separate longitudinal areas, the space over one of which is enclosed and constitutes an exhaust duct, the space over the other being open to atmosphere, said hood having a U-shaped lateral extension the distal end of which is submerged in the water trough and open into said exhaust duct to enable emissions to flow from said hood to said exhaust duct, the bottom of said water trough being sloped laterally to a low point and having drains at the said low point via which particulates that collect therein from the emissions are removed, the improvement comprising a multiple of high pressure water jet nozzles carried on said U-shaped lateral extension and aimed to agitate said particulates and skim the collected solids from the bottom of said trough to enable them to be removed via the drains in said trough, and a water pressure system for supplying water under high pressure to said jet nozzles.

4. The combination according to claim 3, wherein said water pressure system comprises a pump carried on said hood, an intake pipe for said pump extending into the area of said water trough open to atmosphere, and a delivery pipe communicating pressurized water from the said pump to said jet nozzles.

* * * * *

UNITED STATES PATENT AND TRADEMARK OFFICE

CERTIFICATE OF CORRECTION

PATENT NO. : 4,133,721
DATED : January 9, 1979
INVENTOR(S) : Roy Naevestad

It is certified that error appears in the above-identified patent and that said Letters Patent are hereby corrected as shown below:

On the Title Page, under "References Cited", second column, after "Hirahama et al.", "95" should be --98--.

Claim 1, column 9, line 26, "venture-like" should read --venturi-like--.

Signed and Sealed this

*First* Day of *May 1979*

[SEAL]

*Attest:*

RUTH C. MASON
*Attesting Officer*

DONALD W. BANNER
*Commissioner of Patents and Trademarks*